US005596900A

United States Patent [19]

Pietrelli

[11] Patent Number: 5,596,900

[45] Date of Patent: Jan. 28, 1997

[54] TRACTION AND ALIGNMENT ARM PARTICULARLY FOR MOTOR VEHICLE BODY REPAIR BENCHES

[75] Inventor: Giuseppe Pietrelli, Massa, Italy

[73] Assignee: Car Bench S.p.A., Massa, Italy

[21] Appl. No.: 530,145

[22] PCT Filed: Apr. 5, 1994

[86] PCT No.: PCT/EP94/01052

§ 371 Date: Oct. 2, 1995

§ 102(e) Date: Oct. 2, 1995

[87] PCT Pub. No.: WO94/23859

PCT Pub. Date: Oct. 27, 1994

[30] Foreign Application Priority Data

Apr. 8, 1993 [IT] Italy ..... MI93A0716

[51] Int. Cl.[6] ..... B21J 13/08

[52] U.S. Cl. ..... 72/457; 72/455; 72/705

[58] Field of Search ..... 72/705, 455, 457, 72/480, 482

[56] References Cited

U.S. PATENT DOCUMENTS

| | | | |
|---|---|---|---|
| 3,776,022 | 12/1973 | Lionello | 72/705 |
| 4,070,899 | 1/1978 | Venalainen | 72/705 |
| 4,088,002 | 5/1978 | Andrew | 72/705 |
| 4,138,876 | 2/1979 | Chisum | 72/705 |
| 4,398,410 | 8/1983 | McWhorter et al. | 72/705 |
| 4,546,638 | 10/1985 | Field . | |
| 5,016,464 | 5/1991 | Tomelleri | 72/705 |

FOREIGN PATENT DOCUMENTS

| | | |
|---|---|---|
| 0180465 | 5/1986 | European Pat. Off. . |
| 0394203 | 10/1990 | European Pat. Off. . |
| 2102094 | 4/1972 | France . |
| 2246322 | 5/1975 | France . |
| 2145992 | 3/1973 | Germany . |
| 2831627 | 2/1979 | Germany . |

*Primary Examiner*—Daniel C. Crane
*Assistant Examiner*—Ed Tolan
*Attorney, Agent, or Firm*—Guido Modiano; Albert Josif

[57] ABSTRACT

Traction and alignment arm, particularly for motor vehicle body repair benches, including a base which is associable with a repair bench and a post that extends from the base and has traction elements for engaging a portion of the object to be repaired which is placed on the bench. The traction arm includes: a first supporting plate slidably connected to a beam of the bench; a second supporting plate pivotally connected to the first plate for the rotation of the base about a first axis that is substantially horizontal and substantially at right angles to the front plane of the first plate for applying the base to the repair bench; a third supporting plate pivotally connected to the second plate for the rotation of the base about a second axis that is substantially at right angles to the first axis; and pivoting elements for the rotation of the base about a third axis (its own axis) that is substantially at right angles to the second axis. The rotation of the base of the traction arm about these axes can be individually locked by virtue of associated locking elements that can be activated or deactivated in order to vary the position of the post with respect to the repair bench according to the requirements arising from the position of the portion of the object to be repaired and from the direction of the force to be applied to this portion to repair it.

18 Claims, 8 Drawing Sheets

TRACTION AND ALIGNMENT ARM PARTICULARLY FOR MOTOR VEHICLE BODY REPAIR BENCHES

BACKGROUND OF THE INVENTION

The present invention relates to a traction and alignment arm particularly for motor vehicle body repair benches.

Conventional special repair benches are used to repair the body of motor vehicles damaged by accidents; the damaged body is placed on these benches and fixed thereto. The body is then repaired by applying forces, generally traction forces, to the portions damaged by impacts during the accident, so as to return the body as much as possible to its original configuration.

Traction is generally applied to the damaged body portions by means of traction arms which are in most instances constituted by a usually tree-shaped horizontal base which is associable with the repair bench by means of one of its longitudinal ends and supports, at its other longitudinal end, a post which is pivoted to the base and connected to the portions of the part to be repaired that are to be subjected to traction by means of cables, chains or the like. Traction is applied to these cables or chains by means of a fluid-actuated cylinder pivoted to the base of the arm: the end of the stem of the piston of said cylinder acts on the post so as to increase the angle formed by the post and by the base of the traction arm.

In other traction arms, the fluid-actuated cylinder, instead of being interposed between the base and the post, is mounted on the post and acts directly on the chain or cable to apply traction to it. In this last type of arm, the post is generally rigidly associated with the base of the supporting arm instead of being articulated thereto.

In order to vary the direction of the force applied to the body portion to be repaired by means of the cables or chains, the base is associated with the bench by means of two supports: a first one can be rigidly fixed to the bench, whereas the second one is articulated to the first support so as to be rotatable along an arc of preset breadth about a vertical axis and in turn supports the base of the arm so as to be rotatable about a horizontal axis. In this manner it is possible to vary the orientation of the base with respect to the front plane where the traction arm is applied to the repair bench by rotating the base and the second support about the vertical axis, and it is furthermore possible to vary the inclination of the post with respect to a horizontal plane by virtue of the fact that the base is rotatable about its axis with respect to the second support.

Also known from FR-A-2102094 is a traction arm as defined in the preamble of claim 1.

Currently commercially available traction arms can furthermore be rigidly coupled to the bench both along the lateral sides and along the front sides, and the point where the chains or cables are applied to the post can be shifted along the extension of said post so as to allow further variations in the direction of the traction forces applied to the damaged body.

Nevertheless, currently commercially available traction arms are very often unusable, or usable with only partially satisfactory results, in certain repair situations, mainly due to the limitations that in any case occur in the possibility of orientating said arm and therefore the traction forces applied to the damaged regions of the body.

In particular, with currently commercially available traction arms it is extremely difficult to reach the upper and lower regions of the body and apply traction thereto with a correctly orientated force.

SUMMARY OF THE INVENTION

A principal aim of the present invention is to solve the problems described above by providing a traction and alignment arm that is considerably more versatile than currently commercially available traction arms, particularly as regards the possibility of orientating it with respect to the repair bench.

A further aim of the invention is to provide a traction and alignment arm which, by virtue of the great possibilities of orientation it provides, can be simply applied to the sides of a repair bench but nonetheless allows to reach regions of the body to be repaired that are directed toward the front and rear sides of the bench and allows to apply to these regions traction forces that are orientated correctly according to the repair requirements.

Another aim of the present invention is to provide a traction and alignment arm that can reach, by means of chains or cables, upper or lower regions of the body without necessarily requiring the use of guides, to be applied to the repair bench, for the chains or cables.

Another aim of the invention is to provide a traction and alignment arm that is simple and safe to use.

With these aims in view, as well as these and other objects which will become apparent hereinafter, there is provided, according to the present invention, a traction and alignment arm, particularly for motor vehicle body repair benches, as defined in the appended claims.

BRIEF DESCRIPTION OF THE DRAWINGS

Further characteristics and advantages of the traction and alignment arm according to the present invention will become apparent from the following detailed description of a preferred but not exclusive embodiment thereof, illustrated only by way of non-limitative example in the accompanying drawings, wherein.

DESCRIPTION OF THE PREFERRED EMBODIMENTS

Figure 1:
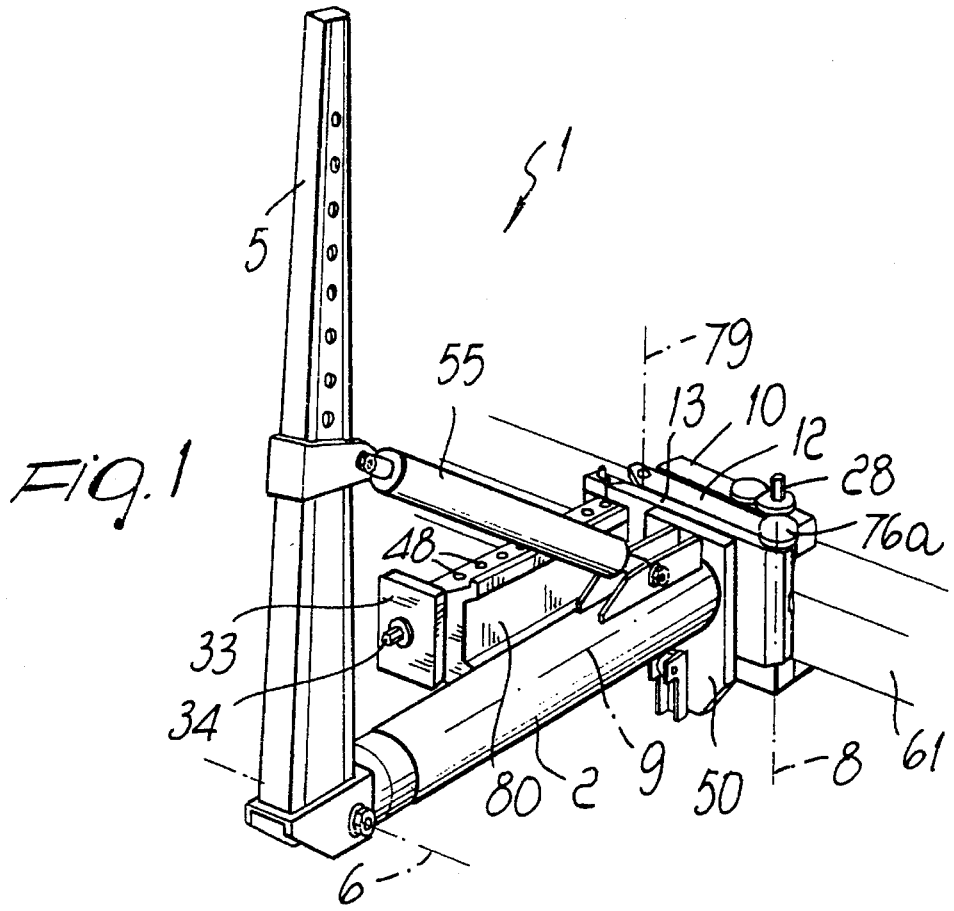
FIG. 1 is a perspective view of the traction arm according to the invention.
Figure 7:
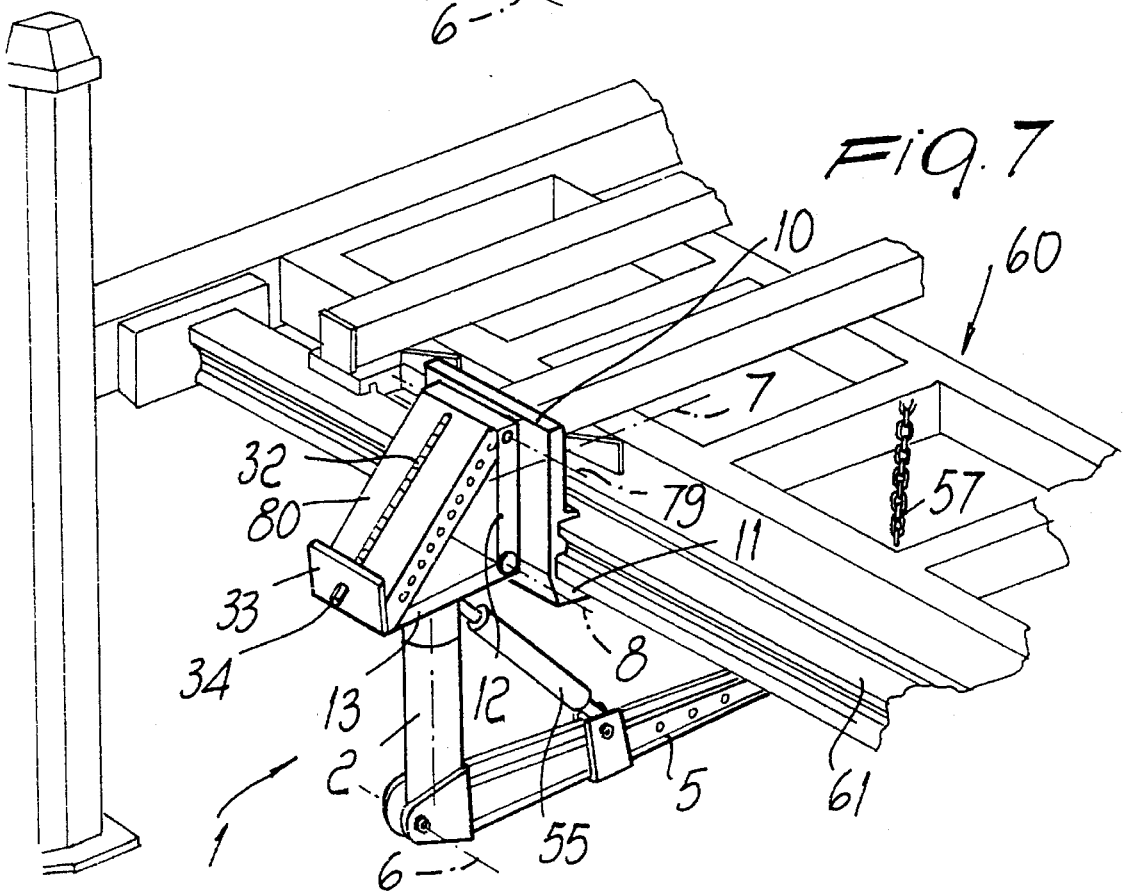
FIGS. 7 to 9 are schematic perspective views of some of the possibilities of use of the traction arm according to the invention.

With reference to the above figures, the traction arm according to the invention, generally designated by the reference numeral 1, comprises a base 2, preferably constituted by a hollow shaft inside which appropriate stiffening partitions 4 are welded to its inner surface, and a post 5 which is pivoted to one end of the base 2 about an axis 6 which is at right angles to the axis 2*a* of the base 2.

The base 2 is associable with a repair bench 60 of a known type, illustrated only schematically in the figures, by means of a series of supports that include: first means for the rotation of the base 2 about a first axis 7 which is substantially horizontal and lies at right angles to the front plane for applying the base 2 to the repair bench 60; second means for the rotation of the base 2 about a second axis 8 which is substantially at right angles to the first axis 7; and third means for the rotation of the base 2 about a third axis 9 which is at right angles to the second axis 8 and preferably coincides with the axis 2*a* of the base 2.

More particularly, the traction arm according to the invention comprises a first vertical supporting plate 10 having, on one face, an L-shaped element 11 by means of which it is associated with a beam 61 of the repair bench 60 and supports, on its opposite face, a second supporting plate 12 so as to be rotatable about the first axis 7. The second supporting plate 12 supports, around the second axis 8, a third plate 13 which in turn supports the base 2 so as to be rotatable about the axis 9.

Figure 2:
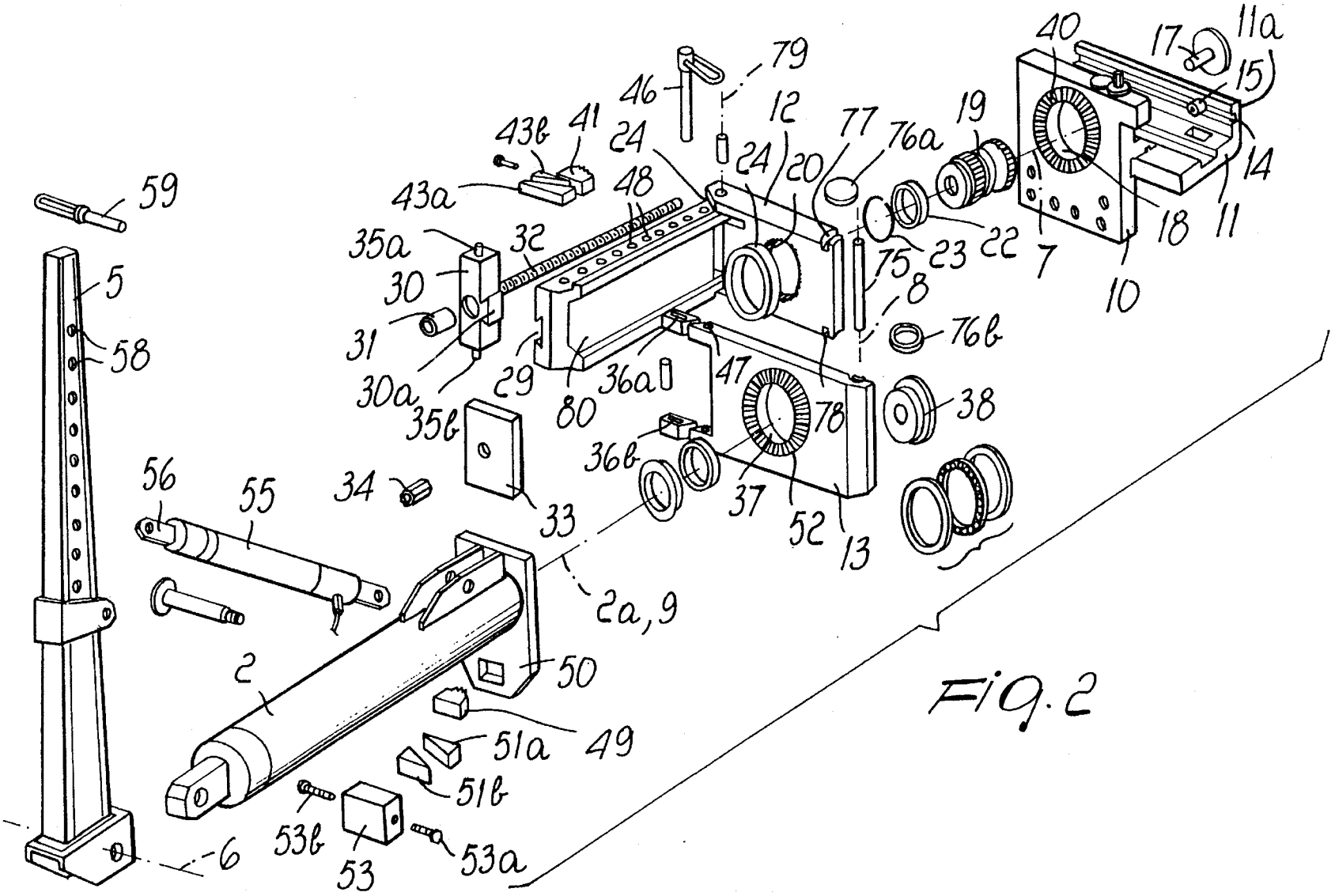
FIG. 2 is an exploded perspective view of the traction arm according to the invention.
Figure 3:
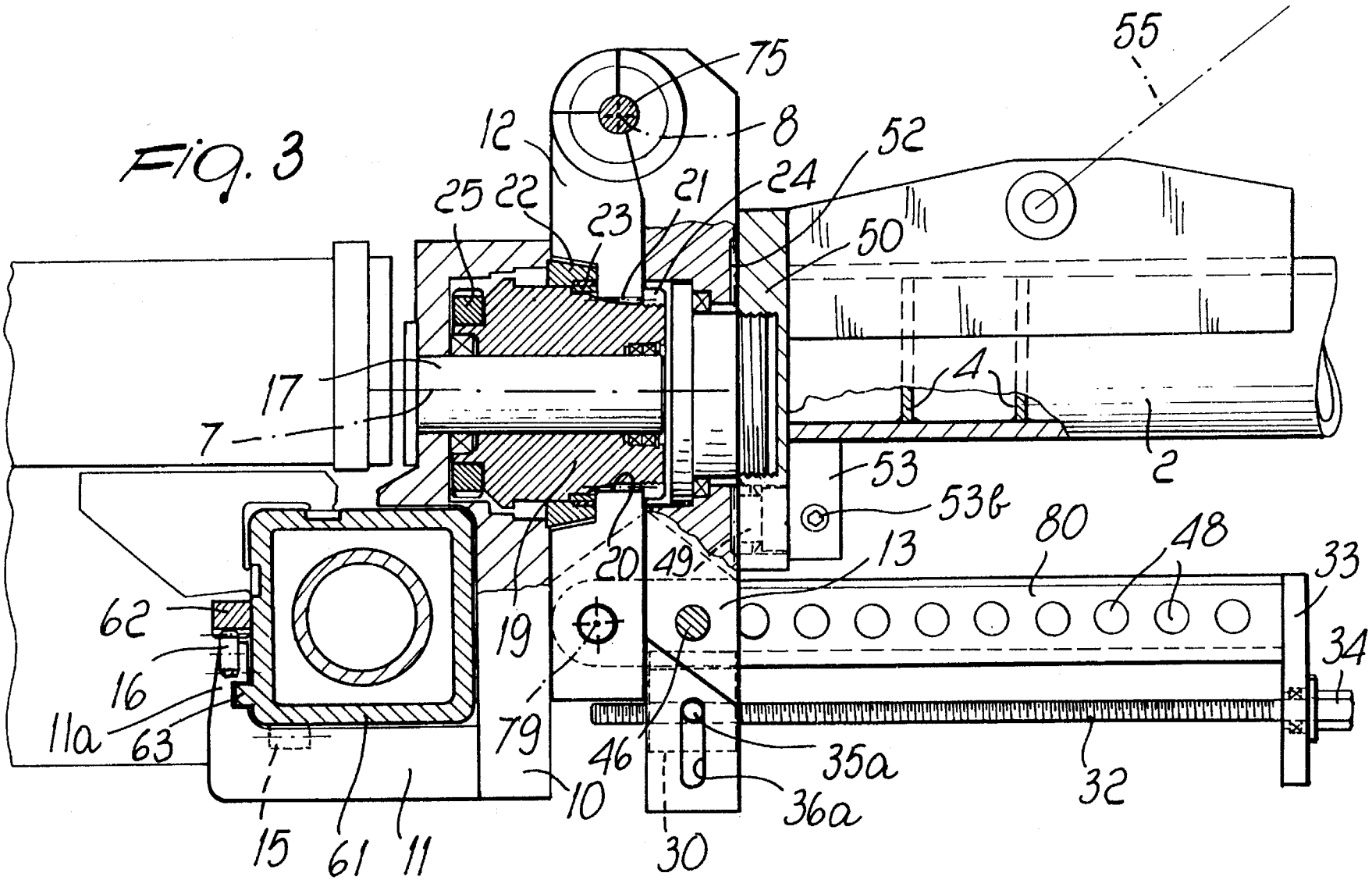
FIG. 3 is a schematic axial sectional view of the traction arm according to the invention.
Figure 4:
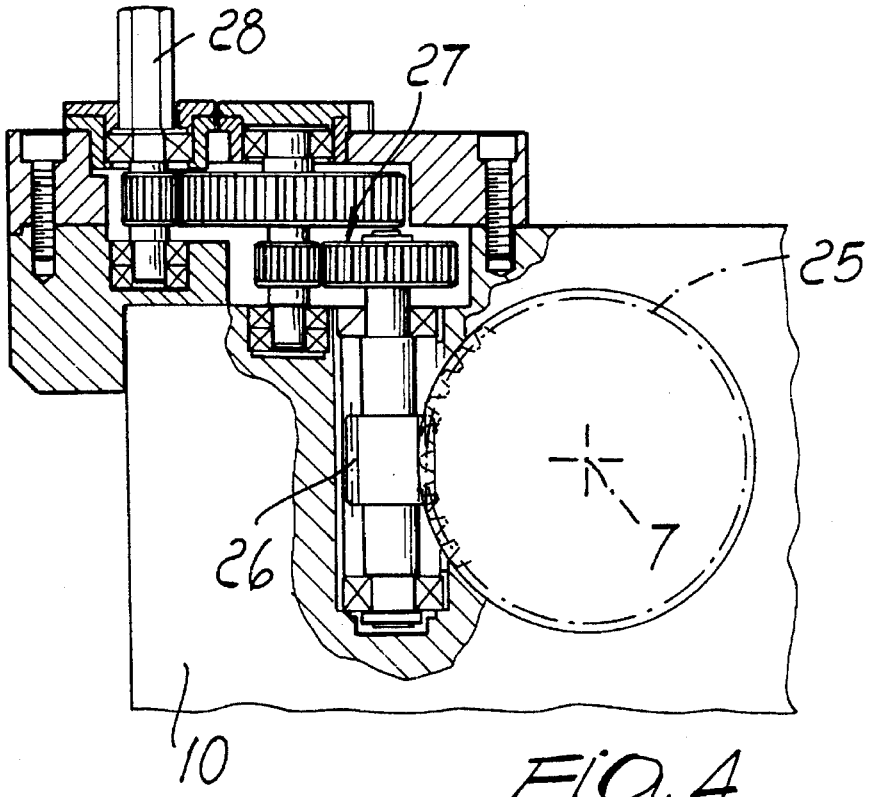
FIG. 4 is an enlarged-scale sectional view of a detail of the first means for rotating the arm, taken along a plane that lies at right angles to the sectional plane of FIG. 3.
Figure 6:
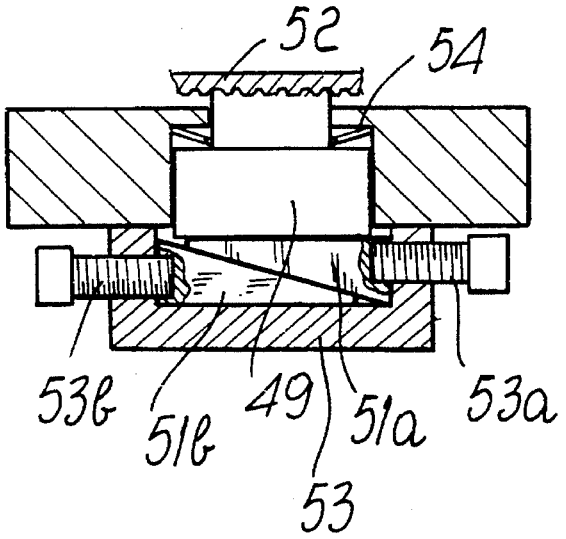
FIG. 6 is an enlarged-scale sectional view of a detail of the third locking means, taken along a plane that lies at right angles to the sectional plane of FIG. 3.
Figure 5:
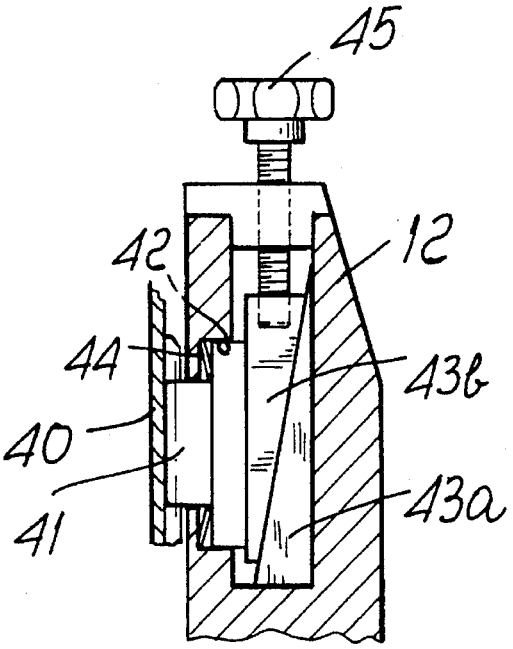
FIG. 5 is an enlarged-scale sectional view of a detail of the first locking means, taken along a plane that lies parallel to the sectional plane of FIG. 3.
Figure 8:
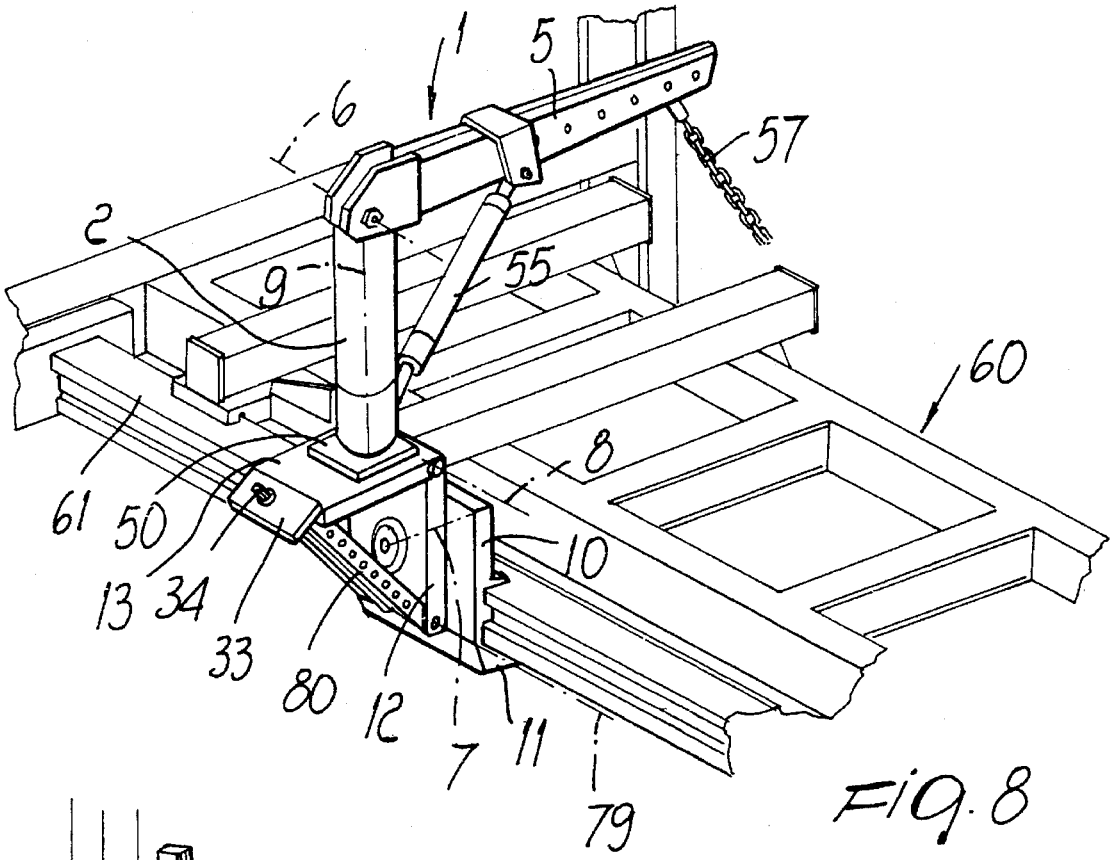
Figure 9:
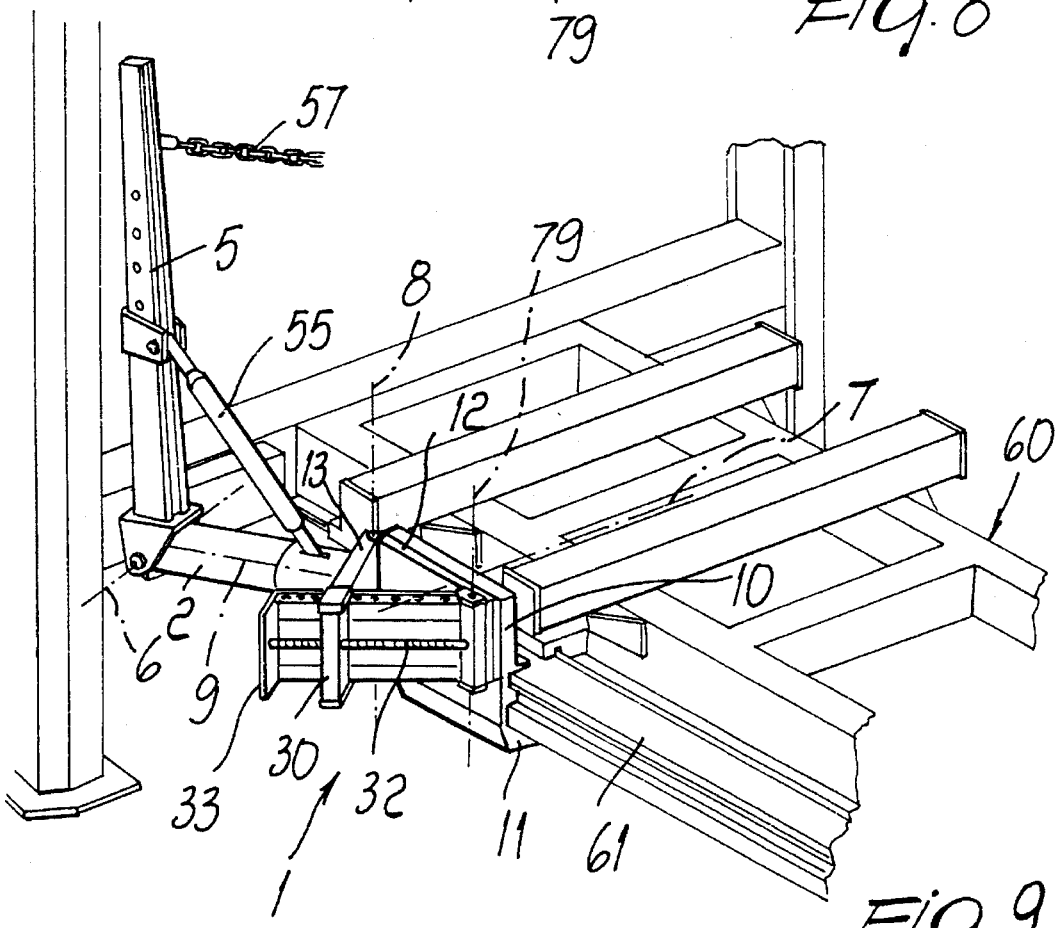

The L-shaped element 11 is constituted by a plate which is arranged substantially at right angles to the plane of arrangement of the plate 10 and has a wing 11*a* which is parallel to, and spaced from, the plate 10 and which has a sliding seat 14 (FIG. 2) to slidingly couple with a longitudinal guide 63 (FIG. 3) which is rigidly coupled to the beam 61 so as to allow the sliding of the plate 10 and therefore of the entire traction arm along the beam 61. In order to reduce sliding friction between the L-shaped element 11 and the beam 61 there are appropriate rollers 15 which are supported by the L-shaped element 11 and act as rolling bearings. The plate 10 can furthermore be made to slide along the beam 61 for example by providing a gear 16 which is rotatably supported by said L-shaped element 11 about its own axis and meshes with a rack 62 which is fixed to the beam 61 and is arranged parallel to the guide 63.

The connection between the first plate 10 and the second plate 12 is provided by means of a pivot 17 the axis whereof coincides with the first axis 7, which is fixed to the plate 10, on the opposite side with respect to the plate 12, at the center of a through hole 18 formed in said plate 10. A coaxial shaft 19 is rotatably supported in the hole 18 about its own axis; one of its ends passes through a hole 20 formed in the second plate 12.

The shaft 19 is conveniently hollow and is supported, so as to be rotatable about its own axis, both by the inner walls of the hole 18 and by the outer surface of the pivot 17 extending inside it. The surface of the hole 20 formed in the second plate 12 is shaped like a ring gear which meshes with a fluted or toothed profile 21 that is provided for this purpose on the portion of the shaft 19 that is accommodated inside said hole 20. The shaft 19 is furthermore locked axially to the first plate 10 by means of appropriate locking rings 22 and 23. In the same manner, the shaft 19 is locked to the second plate 12 in its translatory motion along its own axis by means of a ring 24 which is screwed on the end of the shaft 19 lying opposite the first plate 10 and abutting against the second plate 12.

The rotation of the second plate 12 with respect to the first plate 10 about the first axis 7 can be obtained manually or mechanically by providing a worm wheel 25 arranged around the shaft 19 and rigidly coupled thereto in its rotation about the axis 7. A worm 26 meshes with the worm wheel 25, is supported by the first plate 10 so as to be rotatable about its axis 26*a*, and is connected, by means of a set of gears which is generally designated by the reference numeral 27 and accommodated inside said plate 10, to a shaft 28 protruding from the plate 10 and rotatable about its own axis for example by means of a crank or an electric or pneumatic motor to cause the rotation of the shaft 19 and therefore of the second plate 12 with respect to the plate 10 about the first axis 7.

The second plate 12 supports the third plate 13 so as to be rotatable about the second axis 8, which lies substantially at right angles to the axis 7 and is conveniently spaced laterally from it.

More particularly, the plate 12, through which the hole 20 passes centrally, is pivoted about the axis 8, along ode of its perimetric sides, to a perimetric side of the plate 13. The pivoting between the plate 12 and the plate 13 is provided so that the plate 13 can superimpose itself on the opposite face of the plate 12 with respect to the first plate 10 or swing open about one edge with respect to the second plate 12.

More particularly, the two perimetric sides of the plate 12 and of the plate 13 which are mutually pivoted are provided as portions of a cylindrical seat and rotatably couple to a pivot 75 the axis whereof forms the rotation axis 8. The pivot 75 is axially locked by a pair of caps 76*a* and 76*b* that face the axial ends of the pivot 75 and are fixed to the plate 12. The caps 76*a* and 76*b* have a flanged edge that rotatably couples inside annular grooves 77 and 78 which are concentric with respect to the portions of cylindrical seat formed in the mutually hinged perimetric sides of the plates 12 and 13.

The perimetric side of the plate 12 that is opposite to the side that is hinged to the plate 13 is in turn hinged, about an axis 79 which is parallel to the axis 8, to an auxiliary plate 80 that forms, on the side directed opposite with respect to the axis 8, a dovetail sliding guide 29 that runs at right angles to the axis 79. A correspondingly shaped portion 30*a* of a block 30 couples inside the sliding guide 29; said block 30 internally accommodates an internally threaded bush 31 in which a threaded shaft 32 couples; said shaft is supported, so as to be rotatable about its own axis arranged at right angles to the axis 79, by a panel 33 which is fixed to the perimetric side of the auxiliary plate 80 which is opposite with respect to the side of said plate 80 that is hinged to the plate 12. The end of the threaded shaft 32 which is supported by the panel 33 is rigidly connected to a shaft portion 34 that protrudes from the panel 33 and is rotatable about its own axis manually or by means of an electric or pneumatic motor so as to move the block 30 along the auxiliary plate 80.

The block 30 has, on two opposite sides, two pivots 35*a* and 35*b* that are orientated so that their axis is parallel to the axis 79 and couple within a pair of slots 36*a* and 36*b* which are formed in the plate 13 at its perimetric side that lies opposite the perimetric side that is hinged to the plate 12. In this manner, the movement of the block 30 along the auxiliary plate 80 changes the inclination of the plate 13 with respect to the plate 12 by means of its partial rotation about the axis 8.

A hole 37 passes centrally through the plate 13, and a flanged shaft 38 is inserted therein; the flange of said shaft rests against the side of the plate 13 that is directed toward the plate 12 and is fixed, for example by screwing, inside the end of the base 2 that is directed toward the plate 13. A bearing 39 is conveniently interposed between the flange of the shaft 38 and the plate 13 and facilitates the rotation of the shaft 38 and therefore of the base 2 about the axis 9 with respect to the plate 13.

Advantageously, there are means for locking the rotation of the base 2 about the first axis 7, about the second axis 8 and about the third axis 9.

More particularly, there are first means for locking the rotation of the second plate 12 with respect to the first plate 13; said means are advantageously constituted by a profile 40 which is shaped like a bevel crown wheel and is formed concentrically to the hole 18 on the face of the plate 10 that is directed toward the plate 12, whereas in the plate 12 there is a toothed block 41 that can engage, when required, the bevel crown wheel 40 so as to lock the rotation of the plate 12 with respect to the plate 10 about the axis 7. Inside the plate 12 there is a seat 42 that accommodates a first wedge 43*a* the inclined face whereof couples to a second wedge 43*b* which in turn acts on the toothed block 41 in contrast with a cup-shaped spring 44 that is interposed between the toothed block 41 and a shoulder formed inside the plate 12. The second wedge 43*b* can be moved transversely to the axis 7 by means of a screw-and-nut coupling that is controlled by a knob 45 supported by the plate 12 and protruding therefrom, so as to push the toothed block 41 toward the first plate 10 in contrast with the action of the cup-shaped spring 44 in order to cause the engagement of the toothed block with the bevel crown wheel 40. The movement of the wedge 43*b* in the opposite direction with respect to the wedge 43*a* instead causes the disengagement of the toothed block 41 from the bevel crown wheel 40, allowing the rotation of the second plate 12 with respect to the first plate 10.

The means for locking the rotation of the third plate 13 with respect to the second plate 12 about the axis 8 are instead constituted by a pin 46 that is insertable through a hole 47 formed on the portion of the plate 13 that overlaps the auxiliary plate 80 inside the matching hole of multiple holes 48 formed in the underlying plate 80 and are mutually aligned along a direction that is parallel to the guide 29.

The means for locking the rotation of the base 2 with respect to the plate 13 about the axis 9 are constituted, in a manner similar to what has been described with reference to the locking of the second plate 12 with respect to the first plate 10, by a toothed block 49 which is supported by a flange 50 of the end of the base 2 that is directed toward the plate 13 and, by means of a pair of wedges 51*a* and 51*b*, can engage with, or disengage from, a profile 52 shaped like a bevel crown wheel that is formed on the face of the plate 13 which is directed toward the base 2 concentrically with respect to the hole 37. The relative movement of the wedges 51*a* and 51*b* is obtained by means of screws 53*a* and 53*b* which are supported by a block 53 rigidly fixed to the flange 50, and the movement of the block 49 toward the plate 13 is contrasted by a cup-shaped spring 54 interposed between the toothed block 49 and the flange 50.

Traction means are interposed between the base 2 and the post 5 and are preferably constituted by a fluid-actuated cylinder 55 which is pivoted to the base 2 about an axis that is arranged transversely to the axis 2*a* and is spaced from the axis 6; the end 56 of the stem of the piston of said cylinder is pivoted to the post 5 so that the actuation of said fluid-actuated cylinder 55 causes a partial rotation of the post 5 with respect to the base 2 about the axis 6.

The post 5 furthermore has coupling regions for traction elements 57, such as for example chains or cables, that connect it to the region of the object placed on the repair bench 60 to which traction is to be applied. Said coupling regions are constituted by multiple holes 58 that are distributed along the extension of the post 5 and in which it is possible to insert a locking pin 59 for the chain or cable.

Figure 10:
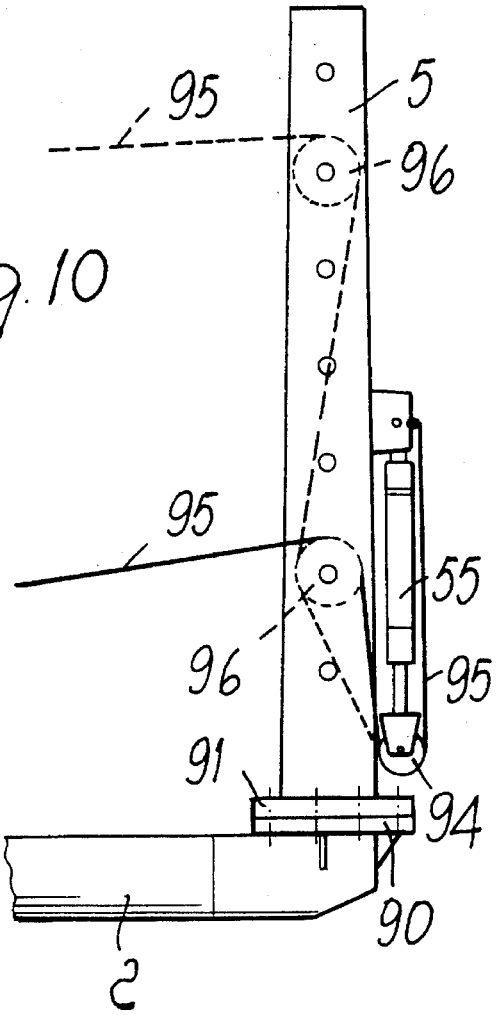
FIG. 10 is a lateral elevation view of a different embodiment of the traction arm according to the invention, illustrating only the base and the post for the sake of simplicity.
Figure 11:
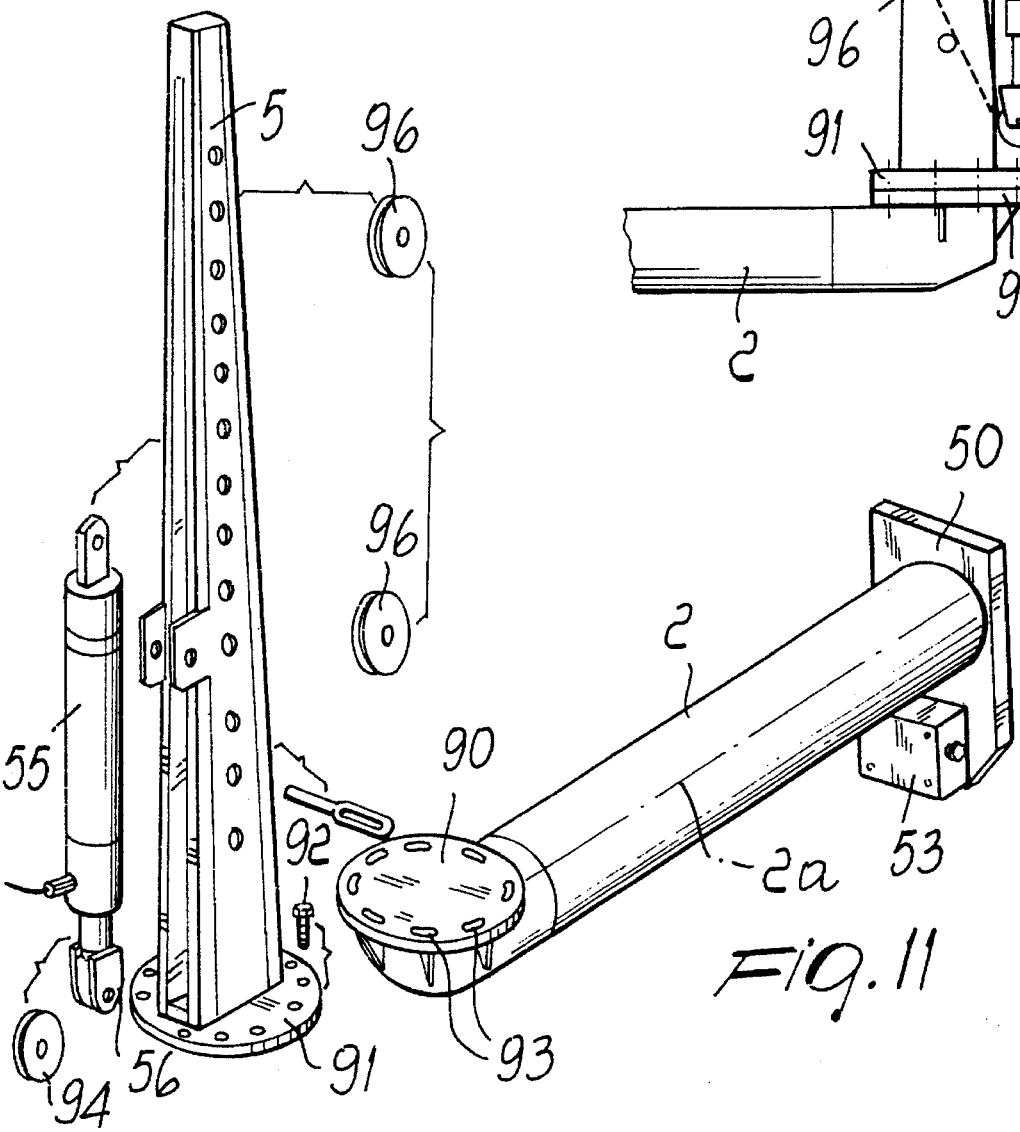
FIG. 11 is an exploded perspective view of the different embodiment illustrated in FIG. 10.

In the embodiment of the traction arm according to the invention illustrated in FIGS. 10 and 11, the post 5, instead of being articulated to the base about the axis 6 at right angles to the axis 2*a* of the base and to the longitudinal axis of said post, is connected to said end of the base 2 so as to be rotatable about its longitudinal axis. The post 5 can be rotated with respect to the base 2 by providing a flange 90 that is rigidly coupled to the end of the base 2 and on which a matching flange 91 of the base of the post rests; the two flanges 90 and 91 are mutually connected by means of bolts 92 that enter holes correspondingly formed in the two flanges, and the holes of at least one flange, in this case the holes 93 of the flange 90, are elongated in an arc-like shape so as to allow, by loosening the bolts 92, a partial rotation of the post about its own axis with respect to the base 2.

In this case, the traction means are again constituted by a fluid-actuated cylinder 55 which instead of running between the post and the base is simply pivoted with one of its ends to the post 5 and supports, with the end 56 of the stem of its piston that is directed toward the base of the post 5, a pulley 94 on which a chain or cable 95 is guided; said chain or cable is fixed to the post 5 at one of its ends and, by being guided on other pulleys 96 supported by said post 5, is fixed with its other end to the region of the body to which traction is to be applied.

Naturally, the embodiment illustrated in FIGS. 10 and 11 relates only to the connection between the base and the post and to the arrangement of the fluid-actuated cylinder that acts on the chain or cable, whereas the set of supporting plates and the associated connections that allow the rotation of the base 2 about the axes 7, 8 and 9 remain unchanged.

Figure 12:
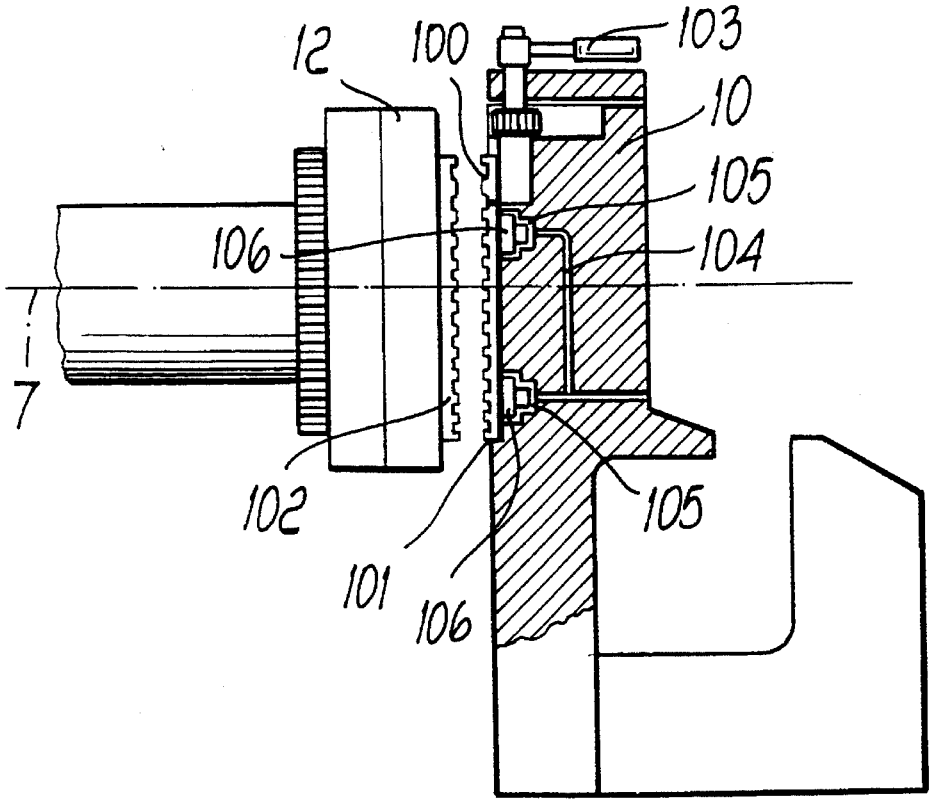
FIG. 12 is a partially exploded sectional view, taken similarly to FIG. 3, of a different embodiment of the first locking means.
Figure 13:
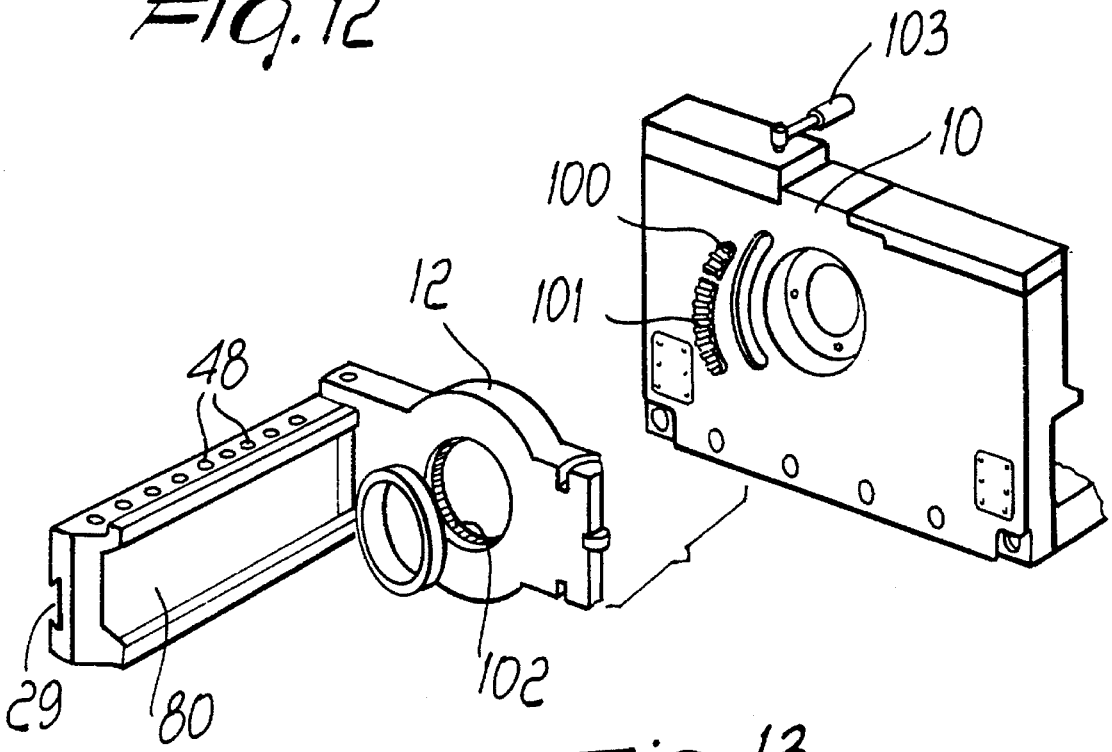
FIG. 13 is an exploded perspective view of a detail of FIG. 12.

FIGS. 12 and 13 illustrate a different embodiment of the first locking means, i.e. of the means that prevent the rotation of the arm about the first axis. In this embodiment, the first locking means include at least one toothed sector 100, 101 that is supported by the first supporting plate 10 so that it can move parallel to the axis 7 and can engage a crown wheel 102 which runs around the first axis 7 and is formed on the side of the second supporting plate 12 that faces the first plate 10. More particularly, a small positioning toothed sector 100 is provided, and an eccentric lever 103 supported by the first plate 10 acts on said sector. The eccentric lever 103 also controls the connection of an oleodynamic duct 104, formed in the first plate 10, to a source of pressurized fluid which is not shown for the sake of simplicity. The duct 104 feeds chambers 105 in which pistons 106 are arranged that act on the active sector 101 toward the second plate 12. In practice, by rotating the lever 103 the toothed sector 100 is engaged and the duct 104 is connected to the pressurized fluid source, producing the thrust of the pistons 106 on the sector 101, which engages the crown wheel 102, locking the rotation of the second plate 12 with respect to the first plate 10 about the axis 7.

Figure 14:
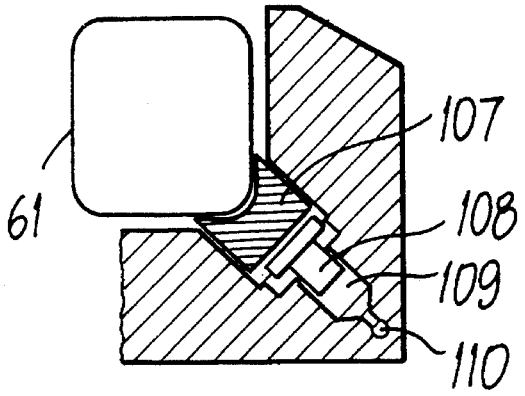
FIG. 14 is a schematic sectional view, taken similarly to FIG. 3, of the means for locking the arm along the repair bench.

FIG. 14 illustrates means for locking the translatory motion of the arm along the beam 61; these means include a locking element 107 which is supported by the first plate 10 and faces an edge region of the beam 61. The locking element 107 can move along a diagonal of the beam 61 by virtue of the action of a piston 108 slideable inside a chamber 109 which is fed by an oleodynamic duct 110 that can be connected by control, in a per se known manner, to a pressurized fluid source in order to move the piston 108, and therefore the locking element 107, toward the beam 61, consequently locking the translatory motion of the arm along the beam 61.

Figure 15:
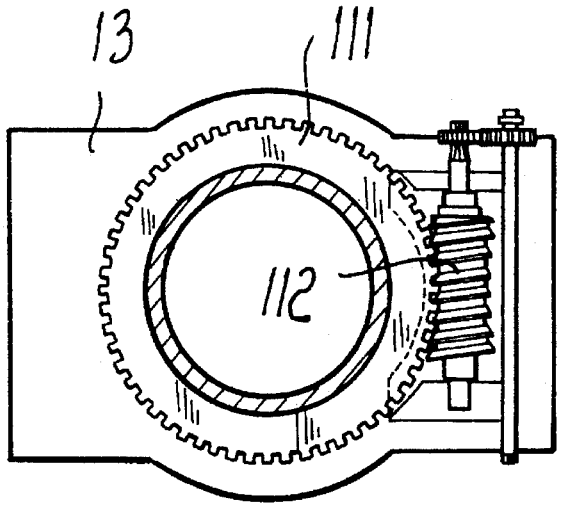
FIG. 15 is a schematic view of a possible automation of the rotation of the arm about the third axis.
Figure 16:
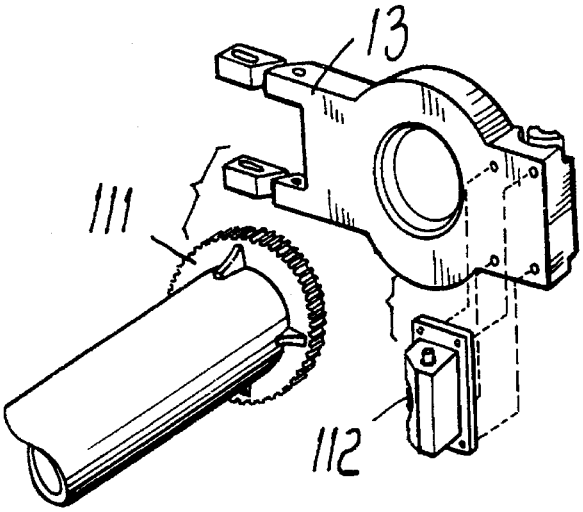
FIG. 16 is an exploded perspective view of the details of FIG. 15.

FIGS. 15 and 16 illustrate a possible automation of the rotation of the base 2 of the arm about the third axis 9. This automation is obtained by providing a worm wheel 111 that is concentric to the third axis 9 on the end of the base 2 that is directed toward the third plate 13 and by placing in the plate 13 a worm 112 that can be rotated about its own axis to produce the rotation of the worm wheel 101 and therefore of the arm about the axis 2*a* of its base that preferably coincides with the third axis 9.

Figure 17:
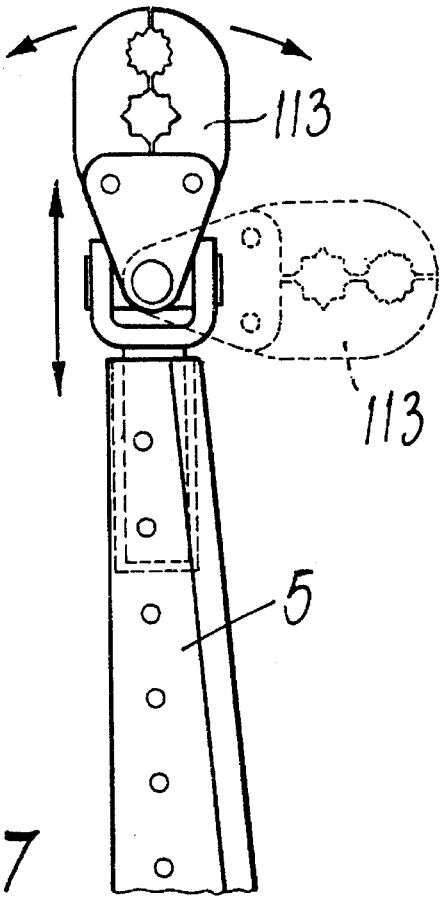
FIG. 17 is a view of a different embodiment of the arm engagement means according to the invention.

FIG. 17 illustrates a possible different embodiment of the means for engaging the arm with the portion of the object to be repaired. In this embodiment, the engagement means are constituted by an articulated clamp 113 of a known type that is associated with the opposite end of the post 5 with respect to the base 2. Said clamp is conveniently slideable along a direction which is parallel to the longitudinal extension of the post 5.

The operation of the traction arm according to the invention is as follows.

After the body to be repaired has been placed and fixed on the repair bench, the traction arm 1, by making use of its ability to slide along a lateral beam 61 of the repair bench 60, and by making use of the ability of the base 2 to rotate by up to 360° about the first axis 7, of the ability of said base 2 to rotate about the second axis 8 through an arc that is preferably comprised between 0° and 90°, and of its further ability to rotate through up to 360° about the third axis 9, is placed without problems in the position that is most suitable to apply, by means of the cables or chains that are rigidly coupled to the post 5 and are subjected to traction by the actuation of the fluid-actuated cylinder 55, a force that is orientated along the direction that is most effective in repairing the body.

As evidence of the high positioning versatility of the traction arm according to the invention, attention is drawn to the fact that although the plate 10 is associated with a lateral beam 61 of the repair bench 60 the post 5 can be moved even onto the front or rear sides of the repair bench. Furthermore, the post 5, by taking advantage of its ability to rotate about the axes 7, 8 and 9, can be moved into a horizontal position above or below the repair bench and can even be inserted inside the body and act directly thereon.

Furthermore, again by virtue of the many possibilities of orientation of the arm according to the invention, it is possible to perform alignment tractions on the sides of the body and on the door posts as well.

In practice it has been observed that the traction and alignment arm according to the invention fully achieves the intended aim since, by virtue of its many possibilities of orientation with respect to the repair bench, it can act on the object to be repaired with a force that is orientated so as to ensure the most effective repairing deformation.

An additional advantage that arises from the directional precision of the traction that can be achieved is that it is possible to avoid producing unwanted deformations of the undamaged parts of the body during traction.

It should be noted that although the arm according to the invention, by virtue of its various orientation possibilities, can provide excellent performance on benches that do not have front- and rear-end supporting beams, it can in any case be mounted on benches that can support said arm even on straight front- and rear-end beams or on curved end beams that mutually connect the side beams.

The traction and alignment arm thus conceived is susceptible to numerous modifications and variations, all of which are within the scope of the inventive concept; all the details may furthermore be replaced with other technically equivalent elements.

What is claimed is:

1. Traction and alignment arm, particularly for motor vehicle body repair benches, which comprises a base which is associable with a repair bench and a post that extends from said base and has means for engaging a portion of the object to be repaired which is placed on said bench, first means for rotation of said base about a first axis that is substantially horizontal and substantially at right angles to a front plane for applying said base to said repair bench; second means for rotation of said base about a second axis that is substantially at right angles to said first axis; and third means for the rotation of said base about a third axis that is substantially at right angles to said second axis; first means for locking the rotation of said base about said first axis; second means for locking the rotation of said base about said second axis; and third means for locking the rotation of said base about said third axis; and in that said locking means can be activated and deactivated to vary the position of said post with respect to said repair bench, wherein said first rotation means couple a first supporting plate about said first axis to a mutually facing second supporting plate, and in that said second rotation means couple a third supporting plate to said second supporting plate about said second axis, said third supporting plate being articulated about one edge thereof to said second supporting plate about said second axis, means being provided to swing said third supporting plate open with respect to said second supporting plate.

2. Traction arm according to claim 1, wherein said first rotation means comprise a pivot coupling between said first supporting plate, which is associable with said repair bench, and said second supporting plate, said pivot coupling forming said first axis, said second rotation means comprising a connection articulated about said second axis between said third supporting plate and said second supporting plate, said third rotation means comprising a pivot coupling between said third supporting plate and said base that forms said third axis.

3. Traction arm according to claim 1, wherein said second axis is spaced laterally, with respect to said first supporting plate, from said first axis, and in that said second axis is laterally spaced, with respect to said third supporting plate, from said third axis.

4. Traction arm according to claim 1, wherein said second supporting plate is articulated to said third supporting plate along one of its perimetric sides and supports, at the opposite perimetric side, an auxiliary plate that is articulated to said second supporting plate about a pivoting axis that is parallel to said second axis, said means for swinging said third supporting plate open comprising a sliding guide which is formed in said auxiliary plate and lies at right angles to said pivoting axis, and a block that is slideable by control along said guide and is pivoted, about an axis that is parallel to said pivoting axis, to the side of said third supporting plate that is opposite to the side that is articulated to said second supporting plate in order to vary the angle formed by said second supporting plate and said third supporting plate.

5. Traction arm according to claim 4, wherein said means for swinging said third supporting plate open with respect to said second supporting plate include a threaded shaft that is rotatably supported about its own axis by said auxiliary plate and is orientated parallel to said sliding guide, said threaded shaft coupling to a female thread that is formed in said block that is slideable along said sliding guide, said threaded shaft being rotatable about its own axis to slide said block so as to vary the swinging opening of said third supporting plate with respect to said second supporting plate.

6. Traction arm according to claim 1, wherein said first locking means comprise a bevel crown wheel profile which is formed on the face of said first supporting plate that faces said second supporting plate and a toothed block that is supported by said second supporting plate and can, by control, engage with, and disengage from, said bevel crown wheel profile of said first supporting plate.

7. Traction arm according to claim 1, wherein said second locking means comprise a pin insertable in a hole formed in a portion of said third supporting plate that is superimposed on a portion of said auxiliary plate and in one of a series of holes that are mutually spaced parallel to the extension of said sliding guide in the underlying region of said auxiliary plate in order to lock said third supporting plate with respect to said auxiliary plate.

8. Traction arm according to claim 1, wherein said third locking means comprise a bevel crown wheel profile formed on the face of said third supporting plate that faces said base and a toothed block that is supported by a flange of said base that faces said third supporting plate and can, by control, engage with, or disengage from, said bevel crown wheel profile of said third supporting plate.

9. Traction arm according to claim 1, wherein it comprises means for rotating said second supporting plate with respect to said first supporting plate.

10. Traction arm according to claim 9, wherein said means for rotating said second supporting plate with respect to said first supporting plate comprise an actuation shaft that is rotatably supported by said first supporting plate about its own axis, which coincides with said first axis, said actuation shaft being connected to said second supporting plate so that it rotates rigidly therewith about its axis and being provided with a worm wheel which is rigidly coupled and coaxial thereto and meshes with a worm accommodated in said first supporting plate and actuatable from the outside of said first supporting plate.

11. Traction arm according to claim 1, wherein it comprises a plurality of coupling regions provided along the extension of said post for cables or chains, for connecting said post to the region of the object to be repaired to which traction is to be applied.

12. Traction arm according to claim 1, wherein said post is articulated to said base about a fourth axis that lies substantially at right angles to said third axis, said fourth axis substantially coinciding with the longitudinal axis of said post.

13. Traction arm according to claim 1, wherein it comprises traction means for varying inclination of said post with respect to said base by rotating said post about said fourth axis, said traction means comprising a fluid-actuated cylinder pivoted to said post at one of its ends and supporting, at an end of the stem of its piston, a guiding pulley for a chain or cable in which one end is connected to said post and the other end can be fixed to the portion to which traction is to be applied.

14. Traction arm according to claim 1, wherein said first locking means comprise a crown wheel formed around said first axis on the face of said second supporting plate directed toward said first supporting plate, and at least one toothed sector supported by said first supporting plate and engageable, by control, with said ring gear in order to lock the rotation of said second supporting plate with respect to said first supporting plate about said first axis.

15. Traction arm according to claim 1, wherein it comprises means for automating the rotation of said base about said third axis.

16. Traction arm according to claim 15, wherein said means for automating the rotation of said base about said third axis comprise a worm wheel, fixed to said base concentrically with respect to said third axis, at an end thereof that is connected to said third supporting plate, and a worm supported by said third supporting plate and meshing with said worm wheel fixed to said base, said worm being rotatable about its own axis for rotating said base with respect to said third supporting plate about said third axis.

17. Traction arm according to claim 1, wherein it comprises means for locking translatory motion of the arm along the beam of said repair bench, said locking means being actuated by fluid-actuated means.

18. Traction arm according to claim 1, wherein said means for engaging the portion of the object to be repaired comprise an articulated clamp connected to an end of said post opposite to said base, said articulated clamp being slideable along a direction which is substantially parallel to the longitudinal extension of said post.

* * * * *